US007438380B2

(12) United States Patent
Ishikawa

(10) Patent No.: US 7,438,380 B2
(45) Date of Patent: Oct. 21, 2008

(54) IMAGE FORMING APPARATUS

(75) Inventor: Kan Ishikawa, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 272 days.

(21) Appl. No.: 11/513,725

(22) Filed: Aug. 31, 2006

(65) Prior Publication Data

US 2007/0046716 A1 Mar. 1, 2007

(30) Foreign Application Priority Data

Aug. 31, 2005 (JP) ..... 2005-251777

(51) Int. Cl.
*B41J 29/393* (2006.01)

(52) U.S. Cl. ..... 347/19; 347/37; 400/326

(58) Field of Classification Search ..... 347/19, 347/37; 400/323, 326, 354.3, 355–6, 692
See application file for complete search history.

(56) References Cited

U.S. PATENT DOCUMENTS 4,550,320 A * 10/1985 Biser et al. ..... 347/77
4,552,475 A * 11/1985 Suzaki et al. ..... 400/144.2
4,657,415 A * 4/1987 Kikuchi et al. ..... 400/59
6,042,217 A * 3/2000 Jones ..... 347/32

FOREIGN PATENT DOCUMENTS

| | | |
|---|---|---|
| JP | 2001138594 | 5/2001 |
| JP | 2002084407 | 3/2002 |
| JP | 2004122635 | 4/2004 |

* cited by examiner

*Primary Examiner*—Lamson D Nguyen
(74) *Attorney, Agent, or Firm*—Reed Smith LLP

(57) ABSTRACT

An image forming apparatus is provided which suppresses a change in posture of a carriage at the time of forming an image without using a biasing force of a spring. The image forming apparatus includes an image forming portion that forms an image on a recording medium by traveling of the carriage with a recording head mounted thereon along a guide portion in a main scanning direction while moving the recording medium in a sub-scanning direction, a posture change detector that detects a change in posture of the carriage, an actuator that corrects a tilt of the carriage with respect to the guide portion, and a control device that suppresses the change in posture of the carriage by driving the actuator according to the change in posture of the carriage detected by the posture change detector.

8 Claims, 10 Drawing Sheets

IMAGE FORMING APPARATUS

CROSS-REFERENCE TO RELATED APPLICATIONS

This application claims the benefit of Japanese Patent Application No. 2005-251777 filed Aug. 31, 2005 in the Japan Patent Office, the disclosure of which is incorporated herein by reference.

BACKGROUND

This invention relates to an image forming apparatus that forms an image on a recording medium by moving a carriage with a recording head mounted thereon. Particularly, this invention concerns an image forming apparatus that can control the posture of the carriage at the time of forming an image.

Conventional image forming apparatus are known to form an image on a recording medium, by moving a carriage with a recording head mounted thereon in a main scanning direction along a guide portion while moving the recording medium in a sub-scanning direction.

In this type of image forming apparatus, when the recording medium is slantingly conveyed at the time of forming an image, each one-line image formed per one scanning of the carriage slants on the recording medium. Thus, the overall image formed on the recording medium is distorted.

In order to solve this problem, for example, an image forming apparatus is proposed which detects a tilt of the recording medium on a conveying path and tilts a center axis of the guide portion, which moves the carriage in the main scanning direction, to a referential main scanning direction according to the detected tilt.

SUMMARY

The proposed image forming apparatus controls the posture of the carriage to the recording medium by adjusting the tilt of the center axis of the guide portion which determines a moving direction of the carriage.

Thus, the above proposed image forming apparatus can form a desired image on the recording medium by changing the moving direction of the carriage when the recording medium is slantingly conveyed. However, the apparatus cannot suppress a possible change in posture of the carriage when the carriage moves along the guide portion.

That is, the carriage is provided with a sliding portion that moves along the guide portion. Since there is a gap between the sliding portion and the guide portion, the posture of the carriage may change due to the gap at the time of traveling of the carriage. The above proposed image forming apparatus cannot, however, prevent such a change in posture of the carriage.

Therefore, while the above proposed image forming apparatus can adjust the traveling direction of the carriage properly in a conveying direction of the recording medium, the apparatus cannot prevent displacement of the recording head with respect to the recording medium, which occurs along the change in posture of the carriage at the time of traveling of the carriage. As a result, the image formed on the recording medium sometimes becomes unclear.

On the other hand, the change in posture of the carriage which occurs at the time of traveling of the carriage can be prevented by providing a biasing member such as a spring in the sliding portion of the carriage and suppressing looseness at the time of traveling of the carriage by a biasing force of the spring.

However, in order to prevent the change in posture of the carriage in this manner, the biasing force of the biasing member must be set to bear the maximum load due to looseness which occurs at the time of acceleration or deceleration of the carriage.

If the biasing force is set as above, looseness of the carriage decreases when the carriage travels at a constant speed. Consequently, the biasing force of the biasing member may unnecessarily increase so that a heavy load, as a sliding load, may be applied to a driving motor of the carriage.

Accordingly, if the biasing member such as a spring is used to prevent the change in posture of the carriage at the time of traveling of the carriage, a torque required for the carriage driving motor is increased. This causes a problem that the size of the carriage driving motor may increase.

There is also another problem that the aforementioned measures cannot handle unexpected disturbance.

The present invention is made to solve the above problems. It would be desirable to suppress a change in posture of a carriage of an image forming apparatus that forms an image on a recording medium, at the time of forming an image without a biasing member like a spring.

It is desirable that an image forming apparatus of the present invention includes an image forming portion that forms an image on a recording medium by traveling of a carriage with a recording head mounted thereon along a guide portion in a main scanning direction while moving the recording medium in a sub-scanning direction, a posture change detector that detects a change in posture of the carriage, an actuator that corrects a tilt of the carriage with respect to the guide portion, and a control device that suppresses the change in posture of the carriage by driving the actuator according to the change in posture of the carriage detected by the posture change detector.

According to the image forming apparatus, when the posture of the carriage starts to change due to a gap between the sliding portion and the guide portion of the carriage at the time of forming an image onto the recording medium by traveling of the carriage in the main scanning direction, for example, the posture change detector detects the change in posture of the carriage, and the control device drives the actuator so as to suppress the detected posture change.

Accordingly, the image forming apparatus of the present invention can stable the posture of the carriage (and the recording head) with respect to the recording medium and improve quality of an image formed on the recording medium.

Also in the present invention, only when there is a change in posture of the carriage, a force for suppressing the posture change is generated from the actuator. Therefore, compared to using a biasing force of a spring to suppress the change in posture of the carriage, a load applied to a driving unit (driving motor, etc.) which moves the carriage can be small. The size of the driving unit (driving motor, etc.) can be also made small.

BRIEF DESCRIPTION OF THE DRAWINGS

The invention will now be described below, by way of example, with reference to the accompanying drawings, in which:

FIGS. 7A and 7B are explanatory views illustrating a posture adjustment device of the carriage, in which FIG. 7A shows a front view and FIG. 7B shows a back view of the posture adjustment device;

DETAILED DESCRIPTION OF THE PREFERRED EMBODIMENT

Figure 1:
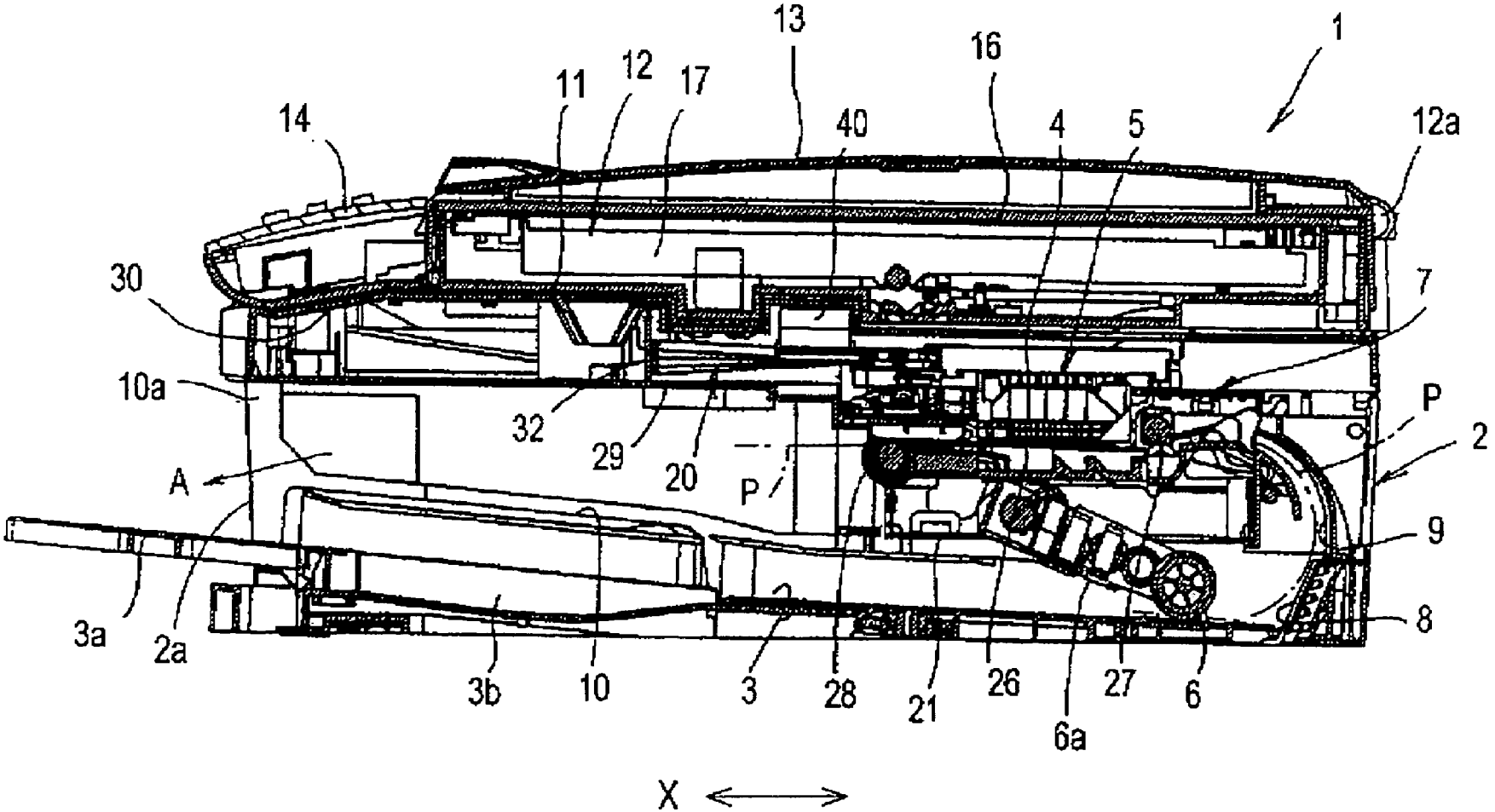
FIG. 1 is a cross sectional side view of an image forming apparatus according to an embodiment.

An image forming apparatus 1 of the present embodiment is a multi function apparatus (MFD) provided with a printer function, a copying function, a scanner function and a facsimile function. As shown in FIG. 1, in the bottom part of a main body 2 of the image forming apparatus 1, a sheet cassette 3 is disposed which can be inserted into or removed from an opening 2*a* provided at the front side (left side in FIG. 1) of the main body 2.

The sheet cassette 3 is designed to store a plurality of sheets P in a stack (accumulated manner), which are cut into sizes like A4, letter, legal, and postcard sizes. The sheets P are set such that their narrow sides are parallel to a main scanning direction (direction orthogonal to the surface of the FIG. 1 drawing, and direction of a Y axis in FIGS. 2 to 4) orthogonal to a sheet conveying direction (sub-scanning direction, i.e., direction of an X axis).

At the front end of the sheet cassette 3, a supplemental support member 3*a* that supports the rear end of the sheets P which are long like those in legal size is movably attached in the direction of the X axis. FIG. 1 shows a state in which the supplemental support member 3*a* is disposed to protrude to the outside from the main body 2. However, if the sheets P are in size like A4 which can be fitted inside the sheet cassette 3 (do not protrude out of the main body 2), the supplemental support member 3*a* can be accommodated inside a storage 3*b* so as not to block feeding of the respective sheets P.

In the rear side (right side in FIG. 1) of the sheet cassette 3, a bank portion 8 for sheet separation is provided. Also, an arm 6*a*, one end of which can be turned in a vertical direction, is provided in the main body 2. By means of a feed roller 6 provided at the other end of the arm 6*a* and the bank portion 8, the sheets P stacked (accumulated) in the sheet cassette 3 can be separately conveyed sheet by sheet.

The separated sheet P is fed to a recording portion 7 provided above (at a high position of) the rear of the sheet cassette 3 via a U-turn path (feed path) 9. The recording portion 7 includes an ink-jet recording head 4 which serves as the printer function of the image forming apparatus 1, and a carriage 5 with the recording head 4 mounted thereon which reciprocates in the main-scanning direction (direction of the Y axis), as later explained.

A discharge portion 10 to which the sheet P after recorded at the recording portion 7 is discharged with its recorded surface turned up is formed above the sheet cassette 3. A discharge opening 10*a* which communicates to the discharge portion 10 is open to the front of the main body 2.

An image reading apparatus 12 that reads a document to implement the copying function and the facsimile function is arranged above the main body 2. A bottom wall 11 of the image reading apparatus 12 is closely attached to the top of a later explained upper cover 30. The image reading apparatus 12 is designed to be opened and closed at one end of the main body 2 about a not shown pivot shank. A rear end of a cover body 13 which covers the upper surface of the image reading apparatus 12 is turnably attached to the rear end of the image reading apparatus 12 so as to be opened and closed about a pivot shaft 12*a*.

An operation panel 14 including various operation buttons and a liquid crystal display is provided ahead of the image reading apparatus 12 above the main body 2. The recording portion 7, the discharge portion 10, and an ink storage 15 (see FIG. 2) provided on one side of the discharge portion 10, are arranged within the projected area in a plan view of the image reading apparatus 12 and the operation panel 14. The length of the sheet cassette 3 in the direction of the X axis is substantially the same with the total length of the image reading apparatus 12 and the operation panel 14 in the direction of the X axis, under the condition that the supplemental support member 3*a* is accommodated inside the storage 3*b*. Accordingly, the image forming apparatus 1 of the present embodiment is a substantially rectangular parallelepiped in shape, which is nearly a square in a plan view. This shape permits easy packing at the time of shipping of the image forming apparatus 1 as a product. Also, reduction in size of a box for packing can be achieved.

A glass plate 16 is provided on the top of the image reading apparatus 12. A document can be set on the glass plate 16 when the cover 13 is opened up. A contact image scanner (CIS) that reads the document is provided below the glass plate 16. The contact image scanner (CIS) can reciprocate in the main scanning direction (direction of the Y axis,) orthogonal to the sheet surface of FIG. 1 drawing.

Figure 2:
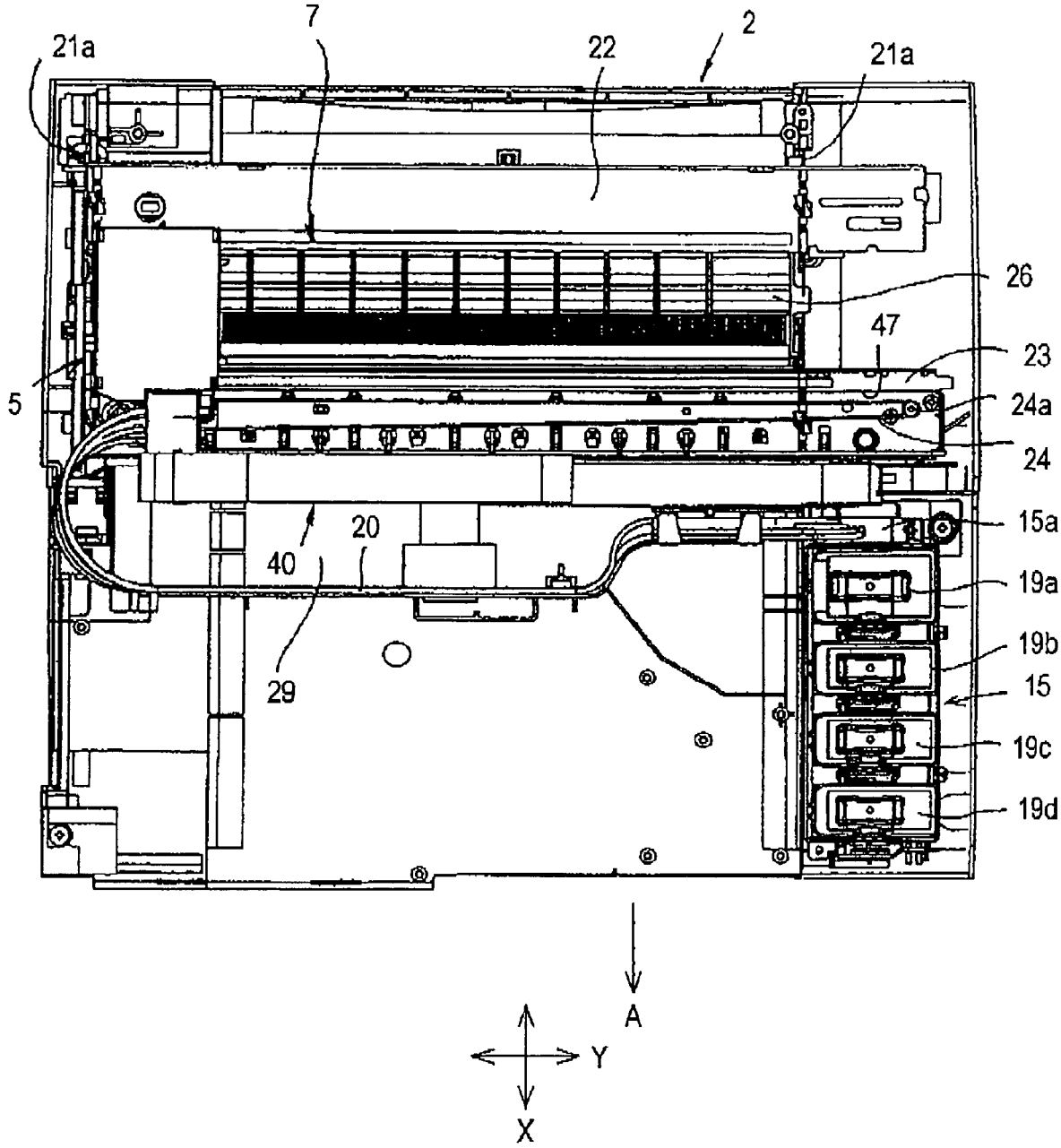
FIG. 2 is a plan view of a main body of the image forming apparatus in a state that an upper cover is removed.

As shown in FIG. 2, the ink storage 15 is designed to open toward the upper side of the main body 2. The ink storage 15 is able to store four ink cartridges 19*a* to 19*d*, each in the form of a substantially rectangular box whose area in a plan view is small and whose height is tall, along the direction of the X axis in a row. The ink cartridges 19*a* to 19*d* respectively store black (Bk) ink, cyan (C) ink, magenta, (M) ink, and yellow (Y) ink for full color recording. The respective ink cartridges 19*a* to 19*d* are designed to be attached and detached from above.

Ink is supplied from the respective ink cartridges 19*a* to 19*d* to the recording head 4 via a plurality of (four in the present embodiment) ink supply tubes 20. If more than four colors (six to eight colors) of ink are used, the ink storage 15 may be designed to store the corresponding number of ink cartridges. The number of ink supply tubes 20 may be increased in accordance with the number of ink cartridges.

Figure 3:
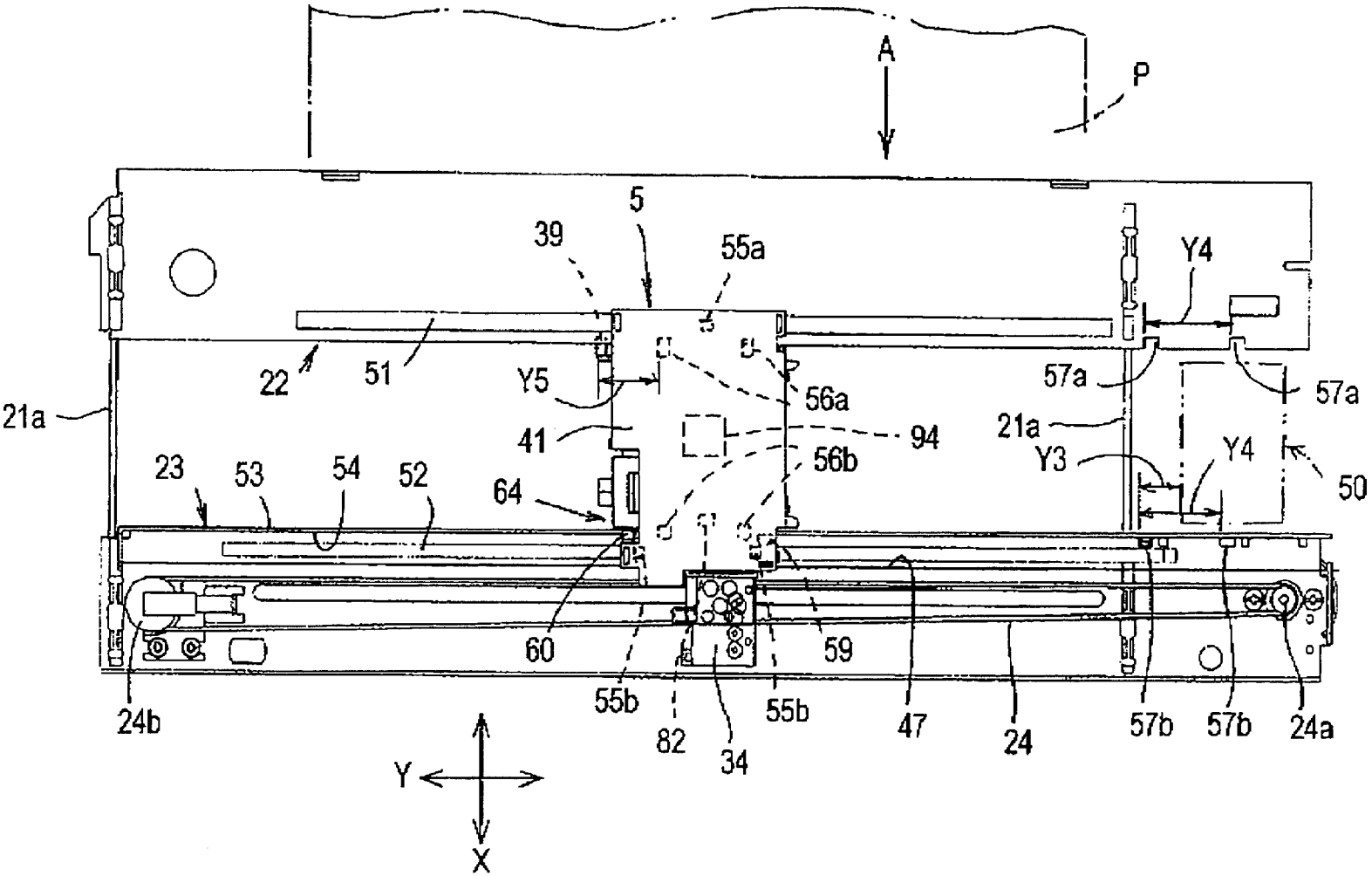
FIG. 3 is a plan view showing a carriage and a pair of guide members.
Figure 4:
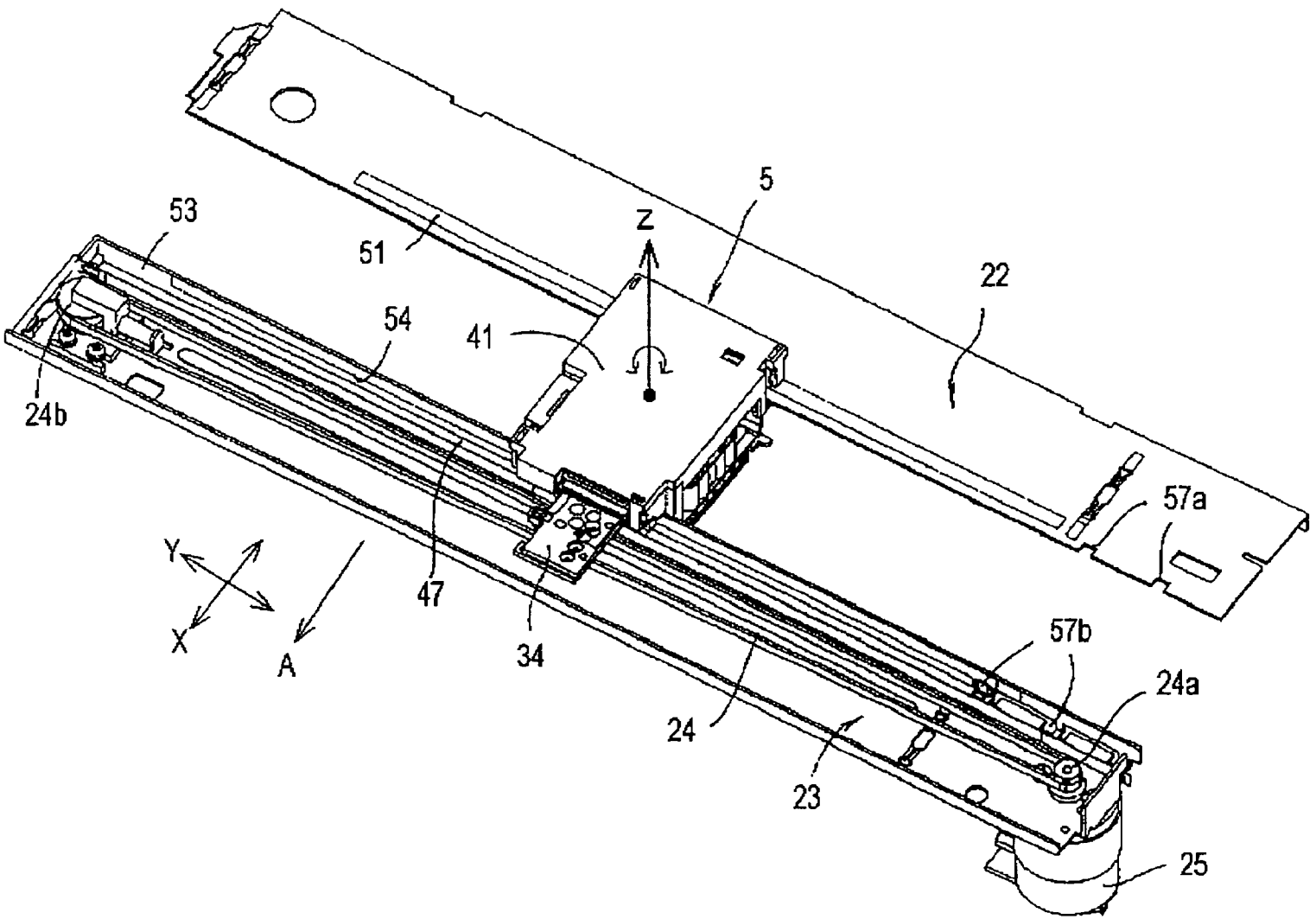
FIG. 4 is a perspective view showing the carriage and the pair of guide members.

As shown in FIGS. 2 to 4, the recording portion 7 includes a first and a second guide members 22 and 23, the carriage 5, a timing belt 24, a CR (carriage) motor 25 (see FIG. 4), a plate-like platen 26, and an encoder strip 47. The first and second guide members 22 and 23 are horizontally long plate-like members. The first and second guide members 22 and 23 are supported by a pair of right and left side boards 21*a* of a main frame 21 (see FIG. 1), and extend in the direction of the Y axis (main scanning direction). The first guide member 22 is located upstream in a sheet delivery direction (direction of arrow A) while the second guide member 23 is located downstream (in the sheet delivery direction). The carriage 5 is slidably supported (mounted) between the first and the second guide members 22 and 23. The timing belt 24 is arranged parallel to the upper surface of the second guide member 23 in order to reciprocate the carriage 5 with the recording head 4 thereon. The CR motor 25 drives the timing belt 24. The platen 26 supports the conveyed sheet P below the recording head 4. The encoder strip 47 is arranged to extend along the main scanning direction to detect the position in the direction of the Y axis (main scanning direction) of the carriage 5. The band-like encoder strip 47 is arranged such that its checkup surface (surface where slits are formed at certain intervals in the direction of the Y axis) runs parallel to a vertical direction.

As shown in FIG. 1, a pair of resist rollers 27 are disposed upstream of the platen 26. The sheet P is delivered to a space between the upper surface of the platen 26 and the bottom surface of the recording head 4 by the resist rollers 27. Also, not shown spurs which are brought into contact with the upper surface of the sheet P and a discharge roller 28 which is brought into contact with the under surface of the sheet P are disposed downstream of the platen 26. The recorded sheet P which has passed the platen 26 is conveyed to the discharge portion 10 by the discharge roller 28.

An ink receiver (not shown) is provided on one side (close to the left side board 21*a* in FIG. 2 in the present embodiment), outside of the width (narrow sides) of the conveyed sheet P. A maintenance unit 50 (see FIG. 3) is provided on the other side (close to the right side board 21*a* in FIGS. 2 and 3).

The carriage 5 is moved to a flushing position in the ink receiver at regular intervals. The recording head 4 discharges ink at the flushing position to prevent clogging of nozzles. The discharged ink is received by the ink receiver. Also, the carriage 5 is moved to the area of the maintenance unit 50 in a standby state. The maintenance unit 50 performs cleaning of the nozzle surface of the recording head 4, selectively sucks ink per color, or performs recovery operation in order to remove bubbles inside a not shown buffer tank on the recording head 4.

The main body 2 also includes a partition (lower cover) 29 which is provided above the discharge portion 10 and extends from the second guide member 23 to the discharge opening 10*a*. The upper cover 30 is provided above the partition (lower cover) 29 so as to cover the carriage 5 and its reciprocation path.

As shown in FIGS. 3 and 4, the first and second guide members 22 and 23 are made of plate-like bodies arranged substantially horizontal, parallel to each other. On the sides close to the carriage 5 on the upper surfaces of the first and second guide members 22 and 23, a first sliding surface 51, 52 is formed in parallel to the bottom surface (head surface where there are nozzles) of the recording head 4 of the carriage 5.

A substantially vertical guide segment 53 is formed by bending an upstream side of the second guide member 23 upward. A second sliding surface 54 facing a downstream side is formed an the guide segment 53.

Figure 5:
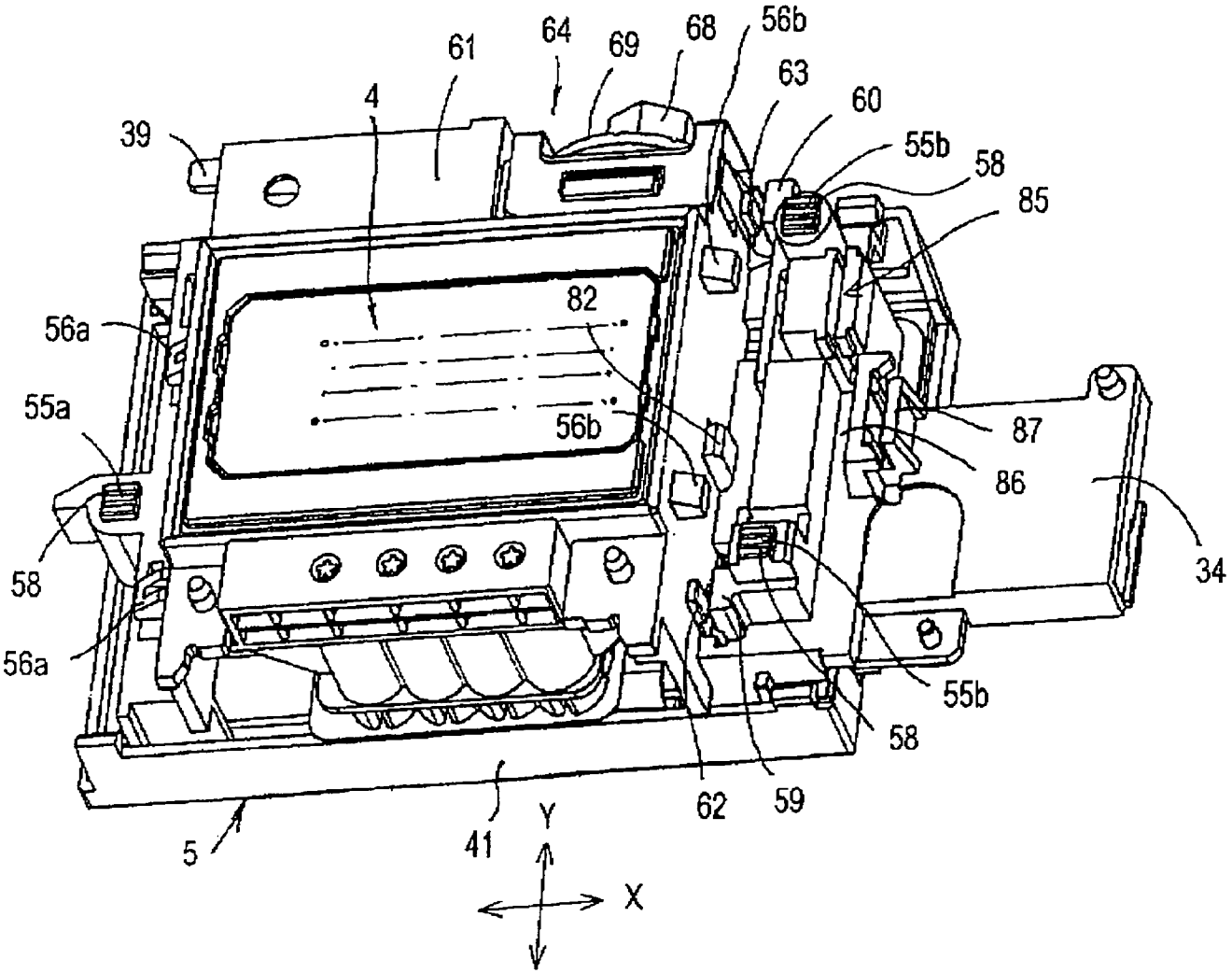
FIG. 5 is a perspective view showing the bottom side of the carriage.

On the other hand, as shown in FIGS. 3 and 5, the carriage 5 includes one first sliding convex portion 55*a* and two first sliding convex portions 55*b* which protrude from the bottom side of the carriage 5 and abut on the first sliding surfaces 51 and 52 of the respective first and second guide members 22 and 23. The carriage 5 also includes a pair of fall-off prevention lugs 56*a* and a pair of fall-off prevention lugs 56*b* which respectively hold the first and second guide members 22 and 23 together with the first sliding convex portions 55*a* and The first sliding convex portion 55*a* which abuts the first sliding surface 51 of the first guide member 22 is arranged substantially in the center part of the carriage 5 in a right and left (main scanning) direction of the carriage 5. The two first sliding convex portions 55*b* which are arranged appropriately spaced in the right and left (main scanning) direction so as to abut on the first sliding surface 52 of the second guide member 23. The two pairs of the fall-off prevention lugs 56*a* and 56*b* face the bottom side of the first and second guide members 22 and 23. One of each pair of the fall-off prevention lugs 56*a* and 56*b* is arranged to the right side, and the other is arranged to the left side of the carriage 5 in a plan view.

Each of the three first sliding convex portions 55*a*, 55*b* and 55*b* is arranged at each apex of a triangle (preferably, isosceles triangle) of the carriage 5 in a plan view. Therefore, the carriage 5 is supported to the first and second guide members 22 and 23 in a stable manner. Also, a plurality of concave grooves 58 for grease retention which extend in the direction of the X axis are formed with a space therebetween on the bottom side (supporting surface, sliding surface) of the first sliding convex portions 55*a* and 55*b*. The concave grooves 58 allow the carriage 5 to lightly slide with its own weight applied to both of the guide members 22 and 23 (see FIG. 5).

Also as shown in FIGS. 3 and 4, two pairs of right and left notches 57*a* and 57*b* are formed at a predetermined position close to the maintenance unit 50 on the first and the second guide members 22 and 23. The left side notches 57*a* and 57*b* are deviated at a distance Y3 from the maintenance unit 50.

The notches 57*a* on the first guide member 22 are formed by cutting off the downstream edge of the first guide member 22 nearly into a rectangular shape in a plan view at two points. The notches 57*b* on the second guide member 23 are formed by cutting off an angle leading to the guide segment 53 into an L-shape in a side cross section at two points.

Also, a distance Y4 between the two notches 57*a* on the first guide member 22 and between the two notches 57*b* on the second guide member 23 are set to be equal to a distance between the two pairs of right and left fall-out prevention lugs 56*a* and 56*b*.

Accordingly, the carriage 5 can be attached to and detached from both the guide members 22 and 23 by letting the two fall-out prevention lugs 56*a* pass through the two notches 57*a* and letting the two fall-out prevention lugs 56*b* pass through the two notches 57*b*. Since the working position for attachment and detachment is close to a standby position of the carriage 5, it is possible to reduce the travel distance of the carriage 5 when attachment or detachment is required.

The carriage 5 includes two sliding convex portions 59 and 60 which abut the second sliding surface 54 of the second guide member 23. The second sliding convex portion 59 is integrally formed with a holder case 61 of the carriage 5 and arranged so as to hold the guide segment 53 together with a holding segment 62. The space between the holding segment 62 and the second sliding convex portion 59 are open in the main scanning direction and downward (see FIG. 5).

The second sliding convex portion 60 and a holding segment 63 are provided on a posture adjustment device 64 that adjusts a posture of attachment of the carriage 5 to the guide segment 53 of the second guide member 23. The second sliding convex portion 60 is provided close to the other side surface of the carriage 5 (at a wide distance from the second sliding convex portion 59).

Figure 6:
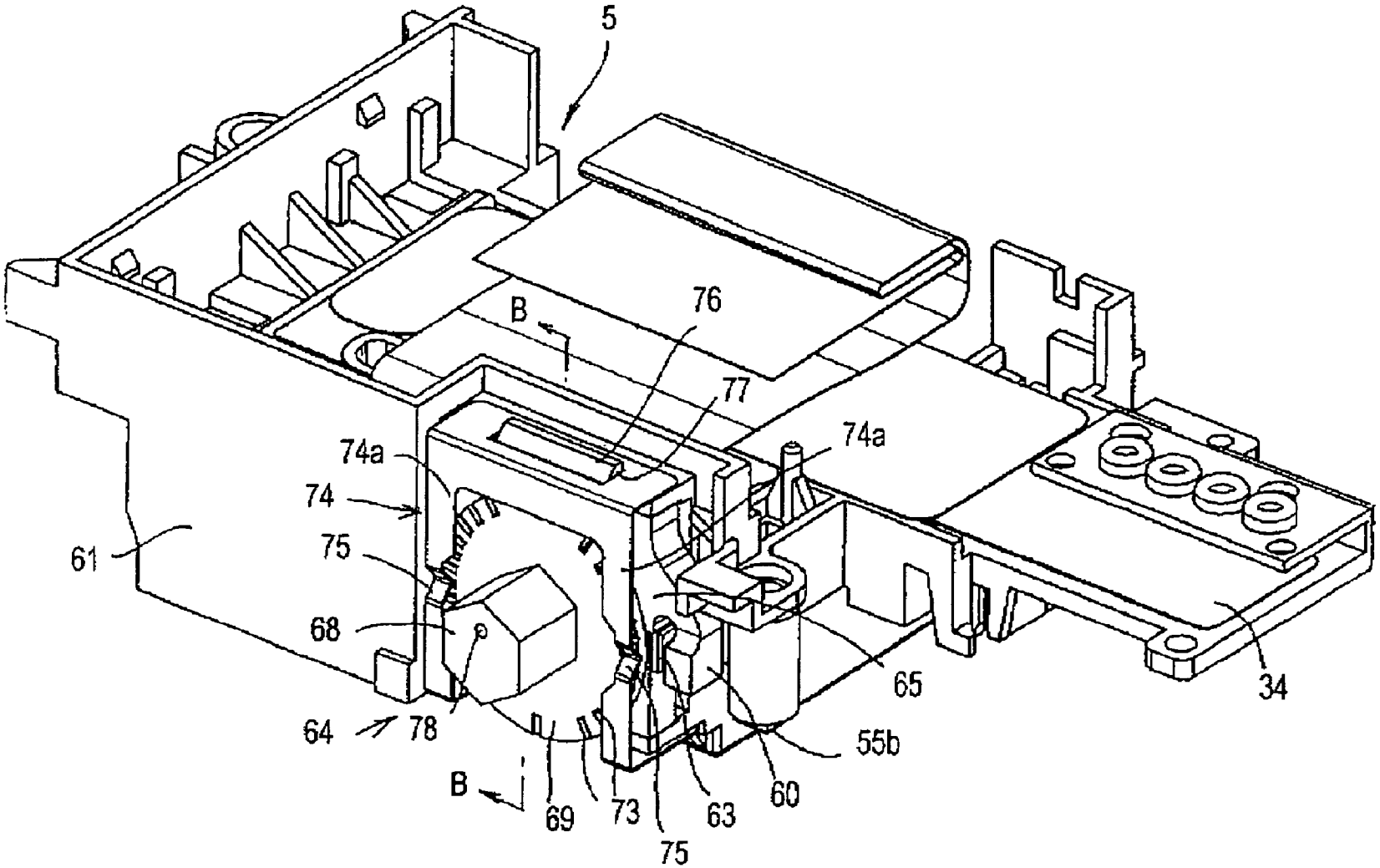
FIG. 6 is a perspective view of the carriage in a state that a lid cover is removed.
Figure 7A:
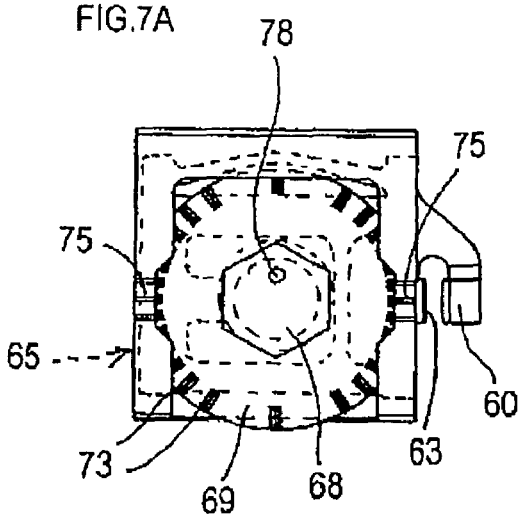
Figure 7B:
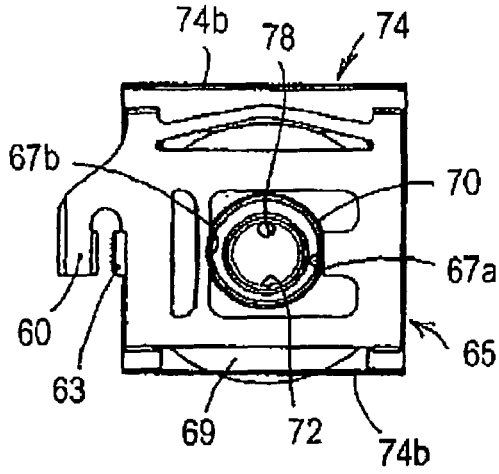
Figure 8:
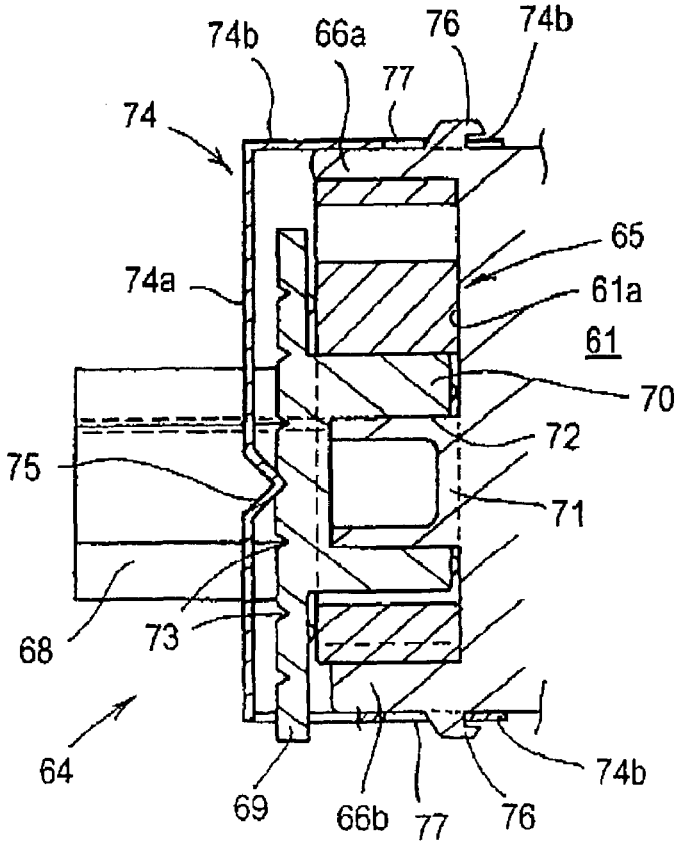
FIG. 8 is a cross sectional view taken by a line B-B in FIG. 6.

As shown in FIGS. 6 to 8, the posture adjustment device 64 includes an adjustment block 65 integrally formed with the second sliding convex portion 60 and the holding segment 63. The adjustment block 65 slidably abuts one side surface 61*a* of the holder case 61, and is further supported by upper and lower guide blocks 66*a* and 66*b* which protrude from the upper and lower parts of the side surface 61*a* so as to be able to slide in the direction of the X axis (see FIG. 8). Also, a pair of abutting surfaces 67*a* and 67*b* facing each other are formed in an inner diameter space of the adjustment block 65 (see FIG. 7).

A dial plate 69 having a control knob 68 on its front side is formed on the adjustment block 65. An eccentric round shank 70 which penetrates the inner diameter space of the adjustment block 65 is integrally formed on the back side of the dial plate 69. A shank hole 72 is formed in the eccentric round shank 70. A round spindle 71 to be fitted into the shank hole 72 protrudes from the side surface 61*a* of the holder case 61.

When the round spindle 71 is fitted into the eccentric round shank 70 of the dial plate 69, the outer peripheral surface (diameter portion) of the eccentric round shank 70 constantly abuts a pair of abutting surfaces 67*a* and 67*b*. Nearer to the outer periphery of the front side of the dial plate 69, concave grooves (notch grooves) 73 which serve as a scale are formed at regular intervals in a circumferential direction. The front side of the dial plate 69 is covered with a plate spring 74 having a U-shaped cross section. The center part of the plate spring 74 is cut off, so that the control knob 68 and the concave grooves (notch grooves) 73 can be exposed.

At the middle part of each flexible segment 74*a* of the plate spring 74, a pressing portion 75 having a V-shaped cross section is respectively formed by flexion (see FIGS. 6 and 8). The pressing portions 75 can be fitted to the concave grooves (notch grooves) 73. Engagement lugs 76 are provided in a protruding manner on the outer surface of the upper and lower guide blocks 66*a* and 66*b* of the holder case 61. Attachment holes 77 that engage with the engagement lugs 76 are formed through upper and lower attachment segments 74*b* of the plate spring 74.

The adjustment block 65 can move in the direction of the X axis according to the rotation position of the control knob 68 (and the dial plate 69) to adjust the protrusion of the second sliding convex portion 60 with respect to the guide segment 53. Accordingly, the posture of the carriage 5 in a plan view can be adjusted on where the sliding surface of the second sliding convex portion 59 abuts on the guide segment 53.

A hole 78 (see FIG. 6) bored on the surface of the control knob 68 is a jig set hole used for setting a rotation position of the dial plate 69, i.e., position of the adjustment block 65 in the direction of the X axis, to a reference position. The reference position corresponds to the position when nozzle rows of the recording head 4 are arranged orthogonal to the guide segment 53 of the second guide member 23.

As shown in FIG. 5, an optical penetration type sensor (photo coupler) 85 is provided in the carriage 5 so as to detect the position of the carriage 5. In the vicinity of a base part between the holder case 61 of the carriage 5 and a connection segment 34 to the supply tube 20, a guide groove 86 where the encoder strip 47 can pass through in the direction of the Y axis is formed being open downward. Adjacent to the guide groove 86, one light-emitting element (not shown) and two light-receiving elements (not shown) of the photo coupler 85 are disposed across the encoder strip 47 (see FIG. 5). That is, the photo coupler 85 is also open in the direction of the Y axis and downward.

Also in the vicinity of the base part between the holder case 61 and the connection segment 34, an attachment 87 for connecting and securing a part of the timing belt 24 is provided. The attachment 87 is provided a little higher position than the positions of pulleys 24*a* and 24*b* provided on both ends of the timing belt 24 (see FIGS. 2 to 4). Therefore, due to a tensile force of the timing belt 24, the carriage 5 is constantly pressed against the upper surface of the second guide member 23.

A lid cover 41 for closing the top of the holder case 61 is detachably attached to the top of the carriage 5. On the back side of the lid cover 41, a control board (not shown) is disposed which receives a signal from a flexible flat cable 40 shown in FIG. 2 and outputs a predetermined driving signal to the recording head 4.

Attachment and detachment of the lid cover 41 is necessary for maintenance such as exchange of the control board. A blocking lug 39 (see FIGS. 3 and 5) which faces the bottom side of the first guide member 22 is integrally formed with the lid cover 41. The blocking lug 39 is disposed at substantially the same height as the fall-off prevention lugs 56*a*. Furthermore, the blocking lug 39 is deviated by Y5 (<Y4, see FIG. 3) from one of the fall-off prevention lug 56*a* in the main scanning direction.

As above, in the carriage 5 of the present embodiment, the second sliding convex portions 59 and 60 and the holding segments 62 and 63 are provided to hold the substantially vertical guide segment 53 formed on the second guide member 23 at both ends of the carriage 5 in the direction of the Y axis. Furthermore, the second sliding convex portion 60 and the holding segment 63 are used to adjust the posture of the carriage 5 on the position of abutment between the second sliding convex portion 59 and the guide slip 53, by adjusting the protrusion of the second sliding convex portion 60 and the holding segment 63 from the carriage 5 by the posture adjustment device 64.

However, posture adjustment by the posture adjustment device 64 is performed when the carriage 5 is stopped. A change in posture of the carriage 5 cannot be adjusted which occurs when the carriage 5 is traveling in the main scanning direction (direction of the Y axis) at the time of forming an image onto the sheet P.

Therefore, the carriage 5 of the present embodiment is designed to automatically correct its posture change, when there is a change in posture of the carriage 5 during the travel in the main scanning direction (direction of the Y axis), by pressing the guide segment 53 of the second guide member 23 to the sliding surfaces of the second sliding convex portions 69 and 60.

That is, a third sliding convex portion 82 which can abut on the guide segment 53 of the second guide member 23 is provided to protrude from the wall surface which faces the sliding convex portions 59 and 60 and where the fall-off prevention lug 56*b* is formed (see FIGS. 3 and 5).

Figure 9A:
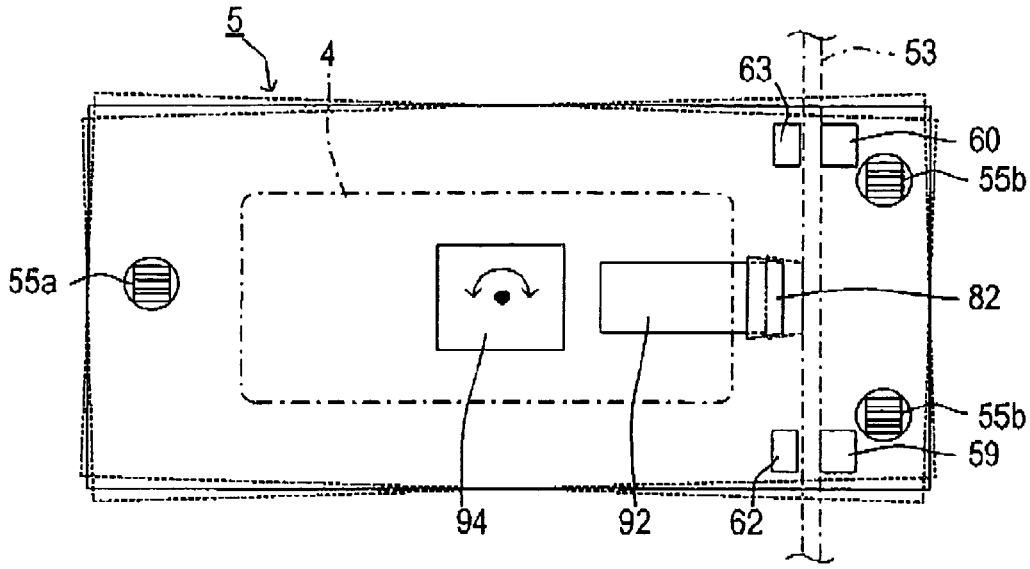
FIG. 9A is an explanatory view illustrating a gyro sensor and a piezoelectric actuator installed in the carriage.

As shown in FIG. 9A, the third sliding convex portion 82 is fixed to a piezoelectric actuator 92 installed inside the carriage 5. When the piezoelectric actuator 92 is elongated due to application of voltage, as shown in dotted lines in FIG. 9A, the third sliding convex portion 82 abuts the guide segment 53 to press the guide segment 53 to the sliding surfaces of the second sliding convex portions 59 and 60.

The carriage 5 also includes a gyro sensor 94 for angular speed detection which is formed through the same semiconductor process with the recording head 4 at the time of manufacturing the recording head 4 (see FIGS. 3 and 9A). The gyro sensor 94 detects an angular speed around a normal line axis (Z axis in FIG. 4) of the head surface of the recording head 4 (i.e., recording surface of the sheet P).

Figure 9B:
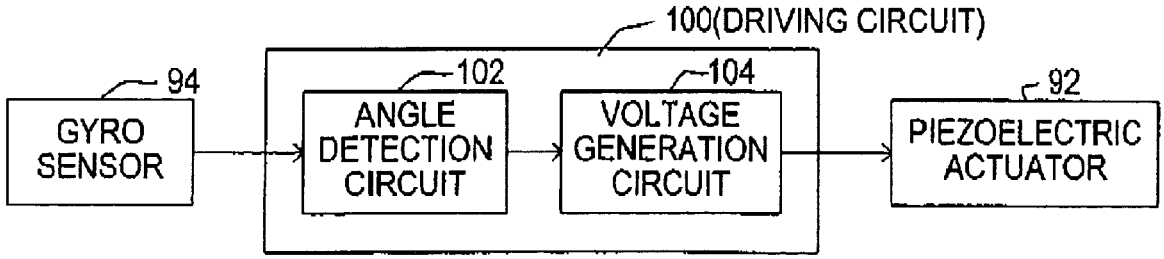
FIG. 9B is an explanatory view illustrating a driving circuit of the piezoelectric actuator.

As shown in FIG. 9B, a detection signal (angular speed) from the gyro sensor 94 is inputted to an angle detection circuit 102 which detects a turning angle around the Z axis of the carriage 5 by performing integration of the detection signal. A detection signal from the angle detection circuit 102 is inputted to a voltage generation circuit 104. The voltage generation circuit 104 generates driving voltage corresponding to the amplitude of the detection signal from the angle detection circuit 102 (i.e., turning angle around the Z axis of the carriage 5) and applies the driving voltage to the piezoelectric actuator 92.

According to the image forming apparatus 1 of the present embodiment, torque around the Z axis is applied to the carriage 5 when the carriage 5 travels in the main scanning direction (direction of the Y axis) to form an image on the sheet P, particularly at the time of acceleration or deceleration of the carriage 5. When the posture of the carriage 5 starts to tilt by the torque with respect to the main scanning direction, the tilt is promptly detected by the gyro sensor 94 and the third sliding convex portion 82 is made to abut the guide segment 53 so as to suppress the change in posture.

As a result, when the posture of the carriage 5 starts to change, the guide segment 53 is held among the second sliding convex portions 59, 60 and the third sliding convex portion 82. The change in posture is restricted. Accordingly, deterioration in quality can be prevented of an image formed on the sheet P.

The piezoelectric actuator 92 is driven only when a change in posture of the carriage 5 is detected by the gyro sensor 94 during the travel of the carriage 5. If no change in posture is detected, the third sliding convex portion 82 is not pressed against the guide segment 53. Thus, compared to the case of suppressing a change in posture of the carriage 5 using a biasing force of a spring, a load applied to the CR motor 25 can be reduced. Decrease in size of the CR motor 25 can be achieved.

Also, the piezoelectric actuator 92 is quick to respond after started to be driven, and generates a large load per unit area. Therefore, even if there is a change in posture of the carriage 5 during image forming (during the travel in the main scanning direction of the carriage 5), it is possible to promptly suppress the posture change and improve the image quality. Additionally, use of the piezoelectric actuator 92 can contribute to decrease in size of the carriage 5.

In addition, the gyro sensor 94 is integrally formed with the recording head 4 through a semiconductor manufacturing process. Therefore, it is possible to reduce manufacturing costs of the image forming apparatus 1. Also, the size of the overall carriage 5 including the recording head 4 can be decreased.

A driving circuit 100 for the piezoelectric actuator 92 including the angle detection circuit 102 and the voltage generation circuit 104 is formed on a control board (not shown) provided on the back side of the lid cover 41 of the carriage 5. The driving circuit 100 operates at the time of image forming by the recording head 4 in response to a signal received from the flexible flat cable 40 shown in FIG. 2.

The sliding surface of the third sliding convex portion 82 which abuts the guide segment 53 when the piezoelectric actuator 92 is driven, the sliding surfaces of the first sliding convex portions 55*a* and 55*b* and the second sliding convex portions 59 and 60, are all formed into a convex curve with respect to the main scanning direction (direction of the Y axis). That is, these sliding surfaces are designed to be in line contact respectively to the first sliding surfaces 51 and 62 and the second sliding surface 54 in the direction of the X axis.

An embodiment of the present invention is described in the above. However, the present invention is not limited to the above embodiment and can be practiced in various manners without departing from the gist of the invention.

Figure 10A:
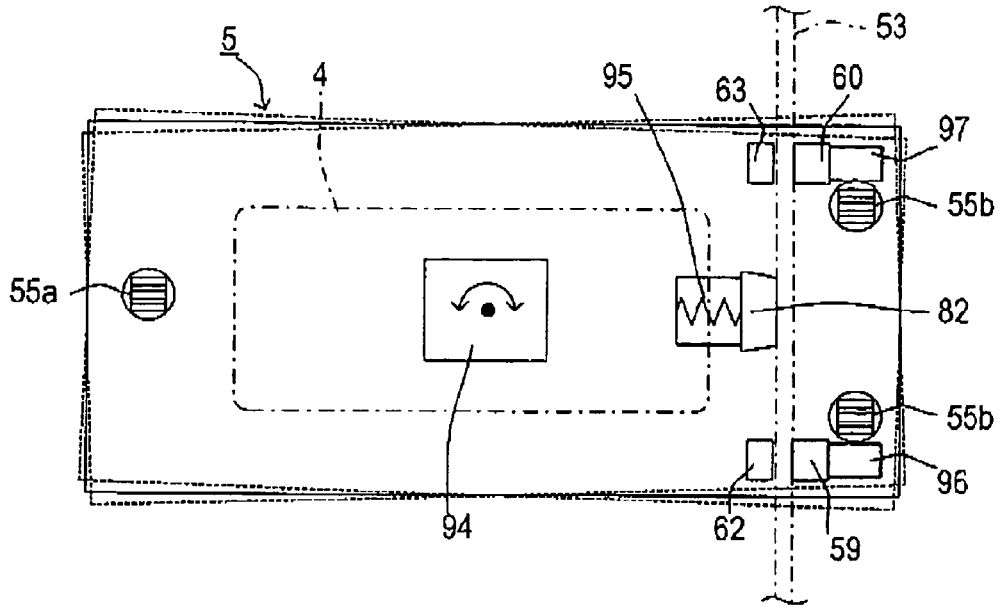
FIG. 10A is an explanatory view illustrating an example of a carriage structure in which a second sliding convex portion is pressed by a piezoelectric actuator.

In the above embodiment, for instance, the third sliding convex portion 82 is provided which abuts the guide segment 53 by a pressing force from the piezoelectric actuator 92 in order to suppress a turn around the Z axis of the carriage 5 which occurs when the carriage 5 travels in the main scanning direction (direction of the Y axis). However, as shown in FIG. 10A, the third sliding convex portion 82 may constantly abut the guide segment 53 by a biasing force of a spring 95 which is designed not to substantially increase a load applied to the CR motor 25. Piezoelectric actuators 96 and 97 may be provided on the side of the second sliding convex portions 59 and 60, opposite to the guide segment 53. When the posture of the carriage 5 is changed against the biasing force of the spring 95 during the travel of the carriage 5 in the main scanning direction, the second sliding convex portions 59 and 60 may be pressed against the guide segment 53 by the piezoelectric actuator 96 and 97.

Figure 10B:
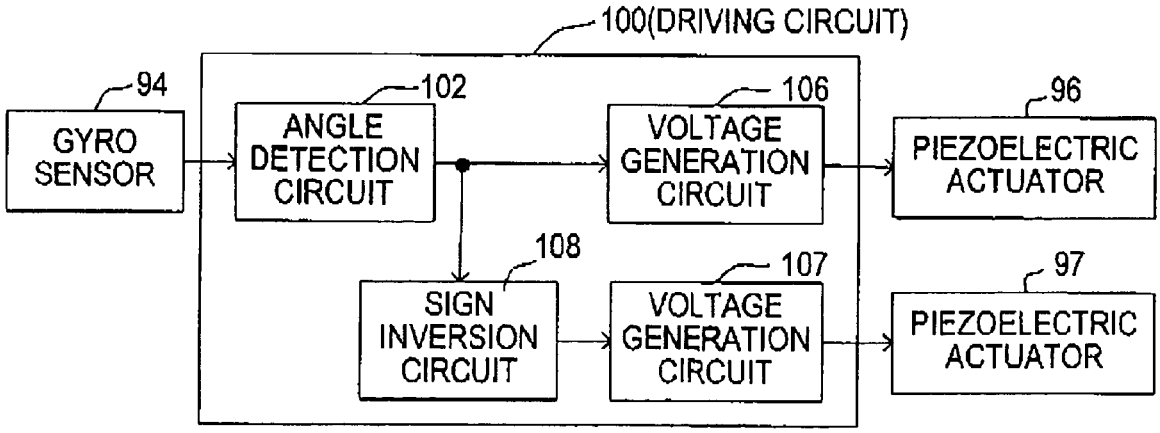
FIG. 10B is an explanatory view illustrating a driving circuit of the piezoelectric actuator.

In the case of pressing the second sliding convex portions 59 and 60 arranged at the right and the left ends of the carriage 5 by the piezoelectric actuators 96 and 97, it is necessary to switch between the piezoelectric actuators 96 and 97 which elongates according to a turning direction around the Z axis of the carriage 5. Therefore, as shown in FIG. 10B, voltage generation circuits 106 and 107 for driving the respective piezoelectric actuators 96 and 97 and a sign inversion circuit 108 which inverts a sign of the turning angle of the carriage 5 detected by the angle detection circuit 102 to generate a detection signal to be inputted to the voltage generation circuit 107 may be provided in a driving circuit for the piezoelectric actuators 96 and 97. The respective voltage generation circuits 106 and 107 may be designed to generate voltage according to a detection signal from the angle detection circuit 102 which indicates a positive turning angle.

In this manner, when the carriage 5 turns to the right around the Z axis in FIG. 10A, the piezoelectric actuator 97 may be driven to press the second sliding convex portion 60 against the guide segment 53 for restriction of the turn. To the contrary, when the carriage turns to the left around the Z axis in FIG. 10A, the piezoelectric actuator 96 may be driven to press the second sliding convex portion 59 against the guide segment 53.

During the travel of the carriage 5 in the main scanning direction, not only the torque around the Z axis, but also a torque around the Y axis along the main scanning direction may be applied to the carriage 5 due to forces applied from the flexible flat cable 40 connected to drive and control the recording head 4 and the ink supply tube 20 for supplying ink to the recording head 4. When the torque around the Y axis is applied to the carriage 5, the recording head 4 is tilted back and forth in the conveying direction of the sheet P, resulting in that irregularity in color may occur in an image.

Figure 11A:
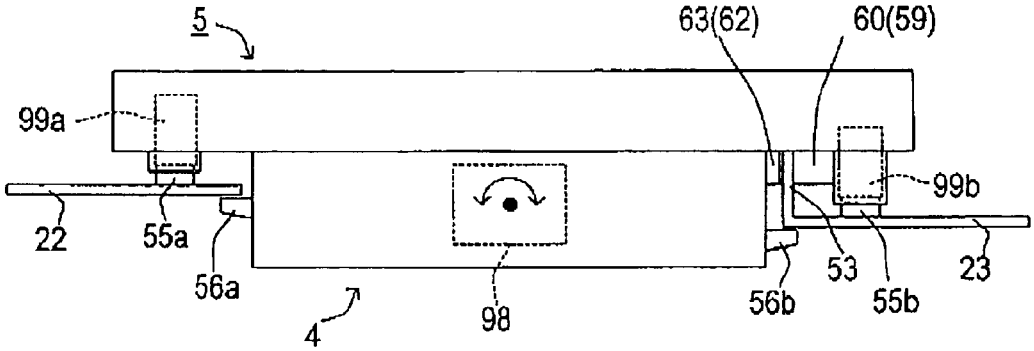
FIG. 11A is an explanatory view illustrating an example of a carriage structure in which a first sliding convex portion is pressed by a piezoelectric actuator.

Therefore, as shown in FIG. 11A, the carriage 5 may be further provided with a gyro sensor 98 which detects an angular speed around the Y axis applied to the carriage 5, and a piezoelectric actuator 99*a* and a pair of piezoelectric actuators 99*b* which press the first sliding convex portion 55*a* and the pair of first sliding convex portions 55*b* respectively against the first sliding surface 51 of the first guide member 22 and the first sliding surface 52 of the second guide member 23. The respective piezoelectric actuator 99*a* and 99*b* may be driven according to a detection signal (angular speed around the Y axis) from the gyro sensor 98.

Figure 11B:
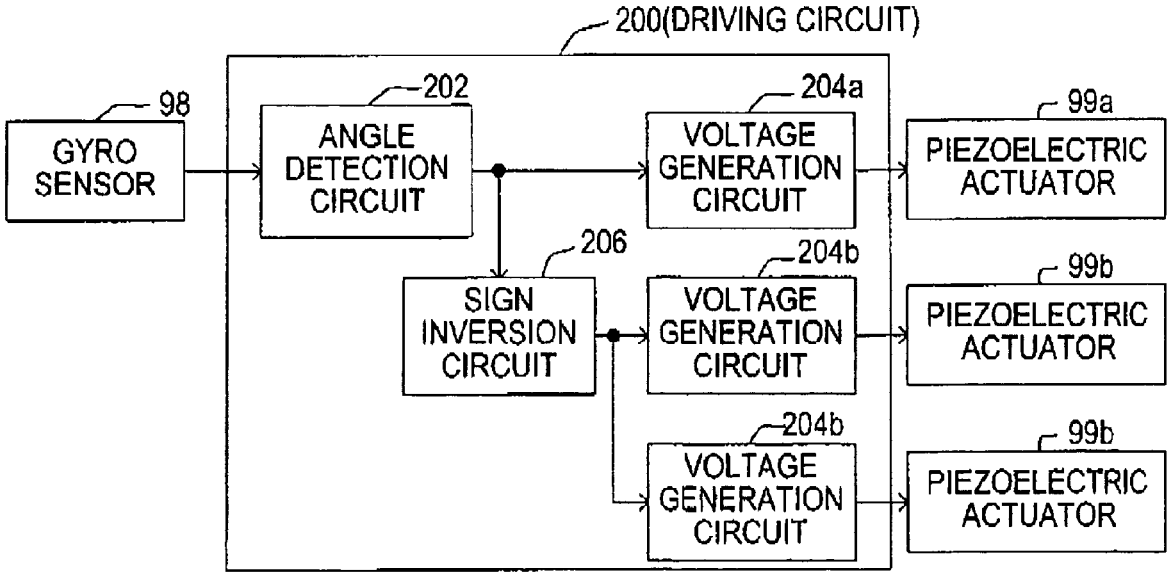
FIG. 11B is an explanatory view illustrating a driving circuit of the piezoelectric actuator.

In this case, as shown in FIG. 11B, a driving circuit 200 for the piezoelectric actuator 99*a* and 99*b* may include an angle detection circuit 202 that detects a turning angle around the Y axis of the carriage 5 by performing integration of the detection signal (angular speed around the Y axis) from the gyro sensor 98, a voltage generation circuit 204*a* that generates driving voltage to drive the piezoelectric actuator 99*a* according to the amplitude of the detection signal from the angle detection circuit 202 when the detection signal indicates that the turning angle is positive (particularly when the carriage turns to the left around the Y axis in FIG. 11A), a sign inversion circuit 206 that inverts a sign of the turning angle obtained by the angle detection circuit 202 to generate a detection signal, and a pair of voltage generation circuits 204*b* that generate driving voltage to drive the respective piezoelectric actuators 99*b* according to the amplitude of the detection signal from the sign inversion circuit 206 when the detection signal indicates that the turning angle is positive (particularly when the carriage 5 turns to the right around the Y axis in FIG. 11A).

Additionally, in the above embodiment, a change in posture of the carriage 5 is detected by a gyro sensor. However, an angular speed sensor such as the gyro sensor is not the only means to detect a change in posture of the carriage 5. For example, a change in posture may be detected by providing an acceleration speed sensor at a distance from the center of the carriage 5.

Furthermore, in the present embodiment, a piezoelectric actuator including a piezoelectric device is used to promptly suppress a change in posture of the carriage 5. However, for example, an electromagnetic actuator such as an electromagnetic solenoid may be used. Also, an actuator for ink discharge provided inside the recording head 4 may be used so that a change in posture of the carriage 5 is suppressed by liquid pressure.

Also in the present embodiment, the photo coupler 85 includes one light-emitting element and two light-receiving elements. However, this is not the only constitution. For example, the photo coupler 85 may include one light-emitting element and three or more light-receiving elements.

What is claimed is:

1. An image forming apparatus comprising:

an image forming portion that forms an image on a recording medium by traveling of a carriage with a recording head mounted thereon along a guide portion in the main scanning direction while moving the recording medium in a sub-scanning direction, a posture change detector that detects a change in posture of the carriage, an actuator that corrects a tilt of the carriage with respect to the guide portion, and a control device that suppresses the change in posture of the carriage by driving the actuator according to the change in posture of the carriage detected by the posture change detector.

2. The image forming apparatus according to claim 1, wherein the posture change detector detects rotation of the carriage around a normal line of a recording surface of the recording medium as the change in posture of the carriage, and the actuator is designed to generate a force that cancels the rotation of the carriage detected by the posture change detector.

3. The image forming apparatus according to claim 2 wherein the posture change detector is integrally formed with the recording head mounted on the carriage, and includes a gyro sensor that detects an angular speed around the normal line.

4. The image forming apparatus according to claim 1, wherein the posture change detector detects rotation of the carriage around an axis parallel to the main scanning direction as the change in posture of the carriage, and the actuator is designed to generate a force that cancels the rotation of the carriage detected by the posture change detector.

5. The image forming apparatus according to claim 4 wherein the posture change detector is integrally formed with the recording head mounted on the carriage, and includes a gyro sensor that detects an angular speed around the axis.

6. The image forming apparatus according to claim 1, wherein the posture change detector detects rotation of the carriage around a normal line of a recording surface of the recording medium and rotation of the carriage around an axis parallel to the main scanning direction, respectively, as the change in posture of the carriage, and the actuator is designed to generate forces that cancel the respective rotations of the carriage detected by the posture change detector.

7. The image forming apparatus according to claim 6 wherein the posture change detector is integrally formed with the recording head mounted on the carriage, and includes a first gyro sensor that detects an angular speed around the normal line and a second gyro sensor that detects an angular speed around the axis.

8. The image forming apparatus according to claim 1, wherein the actuator includes a piezoelectric device that expands and contracts according to applied voltage.

* * * * *